US006332245B2

(12) United States Patent
Stahlecker

(10) Patent No.: US 6,332,245 B2
(45) Date of Patent: Dec. 25, 2001

(54) APPARATUS OF A SPINNING MACHINE FOR CONDENSING A FIBRE STRAND

(75) Inventor: Hans Stahlecker, Haldenstrasse 20, 73079 Suessen (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/766,834

(22) Filed: Jan. 23, 2001

(30) Foreign Application Priority Data

Feb. 7, 2000 (DE) ..... 100 05 387

(51) Int. Cl.[7] ..... D01H 5/00
(52) U.S. Cl. ..... 19/246; 19/236; 19/150
(58) Field of Search ..... 19/150, 236–250, 19/252, 263, 286–288, 304–308; 57/264, 304, 315, 328, 333

(56) References Cited

U.S. PATENT DOCUMENTS 6,108,873 * 8/2000 Barauke ..... 19/236
6,161,258 * 12/2000 Stahlecker ..... 19/286
6,185,790 * 2/2001 Stahlecker ..... 19/246
6,209,303 * 4/2001 Stahlecker ..... 57/304

* cited by examiner

*Primary Examiner*—John J. Calvert
*Assistant Examiner*—Gary L. Welch
(74) *Attorney, Agent, or Firm*—Crowell & Moring LLP

(57) ABSTRACT

A condensing zone for condensing a drafted, still twist-free fiber strand is arranged downstream of a front roller pair of a drafting unit of a spinning machine. An air-permeable transport belt transports the fiber strand through the condensing zone. The transport belt slides hereby over a stationary sliding surface, in which a suction slit of a suction channel is located. At the end of the condensing zone, the fiber strand is pressed with the transport belt by a nipping roller to the sliding surface. The nipping roller as well as the front pressure roller of the drafting unit are supported in a top weighting arm. A separate pressure spring is arranged each for the top pressure roller and for the nipping roller. It can be provided that the nipping roller is arranged at a holding device, which can be swivelled around a swivel axle, which lies coaxially to the axle of the front pressure roller.

16 Claims, 1 Drawing Sheet

APPARATUS OF A SPINNING MACHINE FOR CONDENSING A FIBRE STRAND

BACKGROUND AND SUMMARY OF THE INVENTION

This application claims the priority of German Patent Document 100 05 387.4, filed Feb. 7, 2000, the disclosure of which is expressly incorporated by reference herein.

The present invention relates to an apparatus of a spinning machine for the drafting and subsequent condensing of a fiber strand, comprising a condensing zone located downstream of a front roller pair of a drafting unit, an air-permeable transport belt which transports the fiber strand through the condensing zone, a suction channel arranged at the condensing zone, which suction channel guides the transport belt onto a sliding surface, a suction slit arranged in the sliding surface, a nipping roller which presses the fiber strand and the transport belt to the sliding surface at the end of the condensing zone, a top weighting arm of the drafting unit, which top weighting arm supports the nipping roller and a front pressure roller of the front roller pair, and weighting structure for the front pressure roller and the nipping roller.

Important for the condensing of a fiber strand leaving a drafting unit is that the fiber strand is transported in the condensing zone disposed on an air-permeable transport element and still in a twist-free state and having essentially fibers which lie parallel to one another, and that in the condensing zone an air stream is generated which flows through the transport element, which air stream determines or assists the degree of condensing depending on its width and/or direction and which assists positioning of the fibers transversely to the transport direction so that the fiber strand is bundled or condensed. In the case of a fiber strand condensed in this way, a spinning triangle does not occur, so that the arising thread is more even, tear resistant and less hairy.

An apparatus of the above mentioned type is disclosed in U.S. Pat. No. 6,108,873. In this known apparatus, the front pressure roller and the nipping roller are arranged at a joint rocker, which in turn can be swivelled around a swivel axle. The rocker is held by means of a loading spring, which in turn is arranged in the top weighting arm of the drafting unit. Due to the position of the swivel axle, and thus by means of the choice of lever lengths extending to the front pressure roller and to the nipping roller, the pressure forces of the front pressure roller and the nipping roller can be distributed in the desired ratio.

In practice it has been shown that this system presents problems due to the great differences between the two pressure forces. It is an object of the present invention to avoid this disadvantage of the above mentioned apparatus and to create an apparatus which is more flexible in relation to the loading pressures.

This object has been achieved in accordance with the present invention in that the weighting structure comprises a pressure spring each for the front pressure roller and for the nipping roller.

By this arrangement, the front pressure roller and the nipping roller can be varied and adapted to the required nipping pressures, whereby the fact that the pressure of the front pressure roller is very high due to the high drafting forces and the pressure of the nipping roller, which practically no longer effects a draft, is relatively low, should be taken into consideration. A rocker for the apparatus need not hereby be omitted, which rocker could permit, for example, that the nipping roller is arranged at a holding device, which can be swivelled around a swivel axle, which is disposed coaxially to the axle of the front pressure roller.

In certain preferred embodiments of the invention, the nipping roller can drive the transport belt and in turn be driven by the front roller pair.

Other objects, advantages and novel features of the present invention will become apparent from the following detailed description of the invention when considered in conjunction with the accompanying drawings.

DETAILED DESCRIPTION OF THE DRAWINGS

Figure 1:
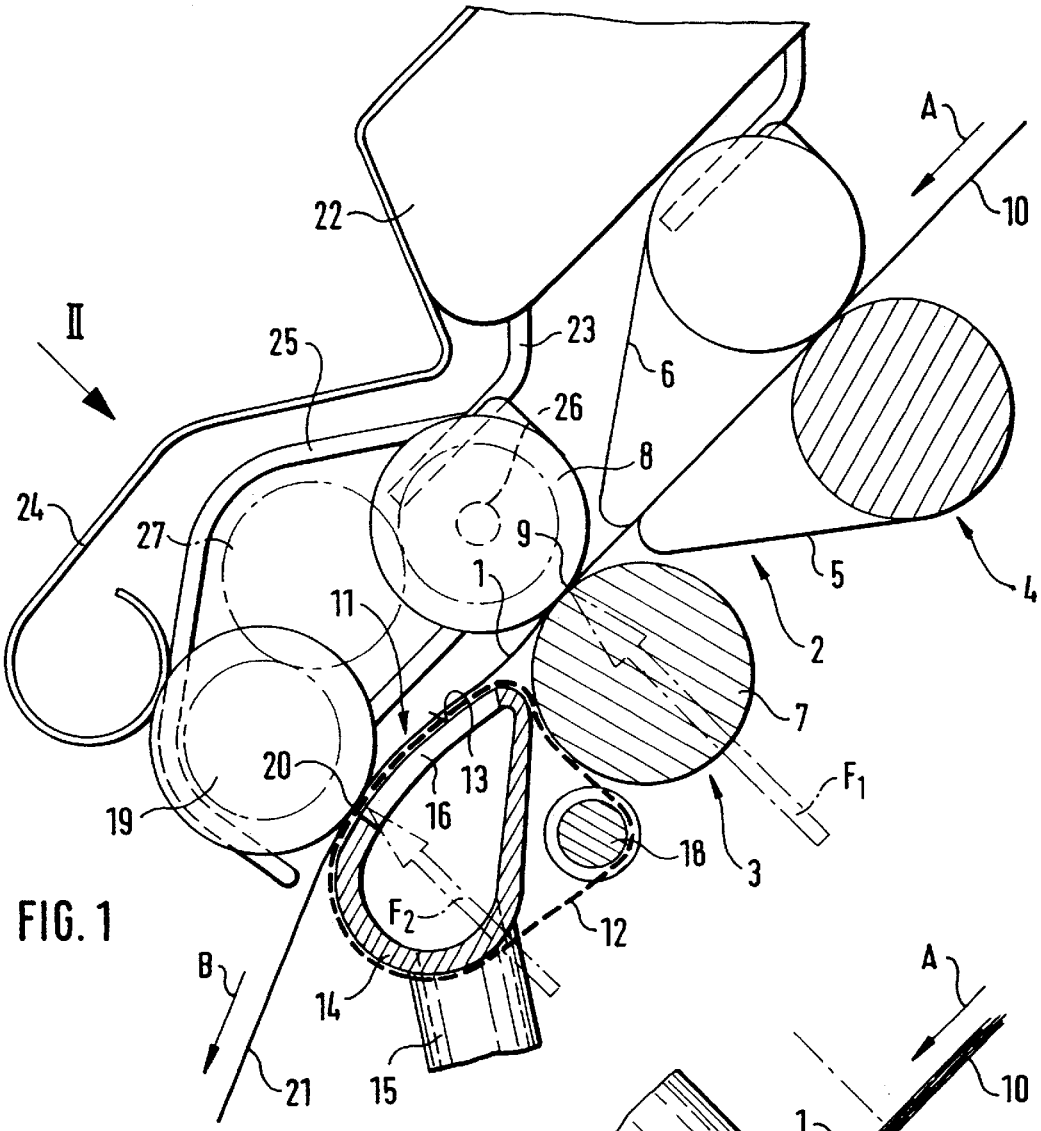
FIG. 1 is a part sectional side view of an apparatus constructed according to a preferred embodiment of the present invention.
Figure 2:
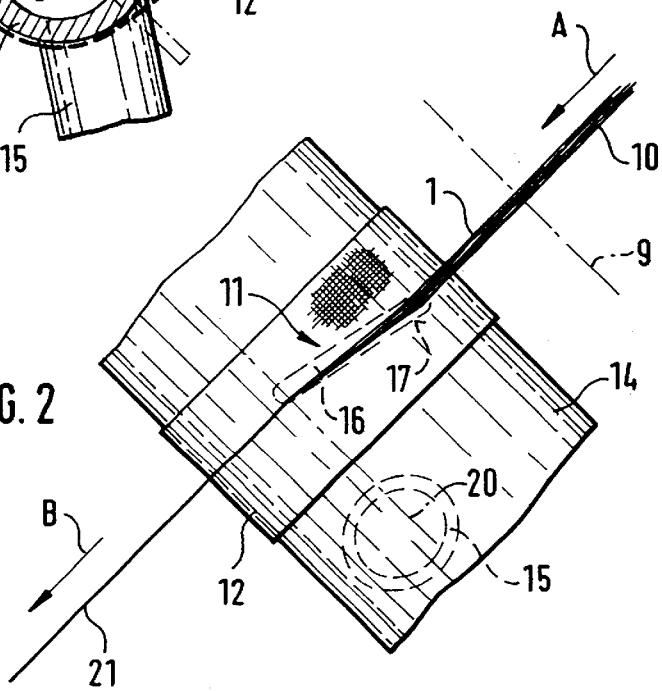
FIG. 2 is a view in the direction of the arrow II of FIG. 1 of the actual condensing zone.

Of an apparatus for drafting and subsequently condensing a fiber strand 1 in a spinning machine, in particular a ring spinning machine, only the area of a drafting unit 2 is shown.

Of the drafting unit 2 itself only a front roller pair 3 as well as an apron roller pair 4 located upstream thereof having a bottom apron 5 and an upper apron 6 are shown. The front roller pair 3 in turn comprises a driven bottom cylinder 7 as well as a front pressure roller 8, which defines, with the bottom cylinder 7, a front nipping line 9. The drafting zone of the drafting unit 2 ends at the front nipping line 9.

In the drafting unit 2 a sliver or alternatively a roving 10 is drafted in transport direction A to the desired fineness in a known way. A condensing zone 11 is located directly downstream of the front roller pair 3, in which condensing zone the drafted, but still twist-free fiber strand 1 is bundled or condensed in a way described herein.

An air permeable transport belt 12 is part of the condensing zone 11, which transport belt 12 can take the form of a fine-meshed woven belt made of polyamide threads. The transport belt 12 transports the fiber strand 1 to be condensed through the condensing zone 11 and is guided in turn hereby over a stationary sliding surface 13. In the case of the sliding surface 13, what is involved here is preferably the outer contour of a suction channel 14, which preferably extends over a plurality of spinning stations. The suction channel 14 is connected with a vacuum source (not shown) by means of a vacuum conduit 15.

A suction slit 16 is located in the sliding surface 13, which suction slit 16 extends essentially in transport direction A, but slightly transversely to the travelling direction of the transport belt 12. The suction slit 16 has, on its inner side in travel direction, a so-called bundling edge 17, along which the fiber strand 1 to be condensed moves and at the same time is false twisted.

Apart from the sliding surface 13, the transport belt 12 is also guided over a tension element 18, which is arranged at a distance to the suction slit 16 and can take the form of, for example, a rod or a roller. The placing of the components is so arranged that the transport belt 12 can be disposed with a slight pressure on the driven bottom cylinder 7. As the bottom cylinder 7 and the transport belt 12 run in opposing directions at the point of contact, the transport belt 12 is cleaned in this way of adhering fiber fly.

On the exit end of the condensing zone 11, a nipping roller 19 is provided which drives the transport belt 12 and which presses the fiber strand 1 together with the transport belt 12 against the sliding surface 13 at a delivery nipping line 20. The delivery nipping line 20 thus borders the condensing zone 11 and acts at the same time as a twist block for the spinning twist to be subsequently applied, which should not run back to the condensing zone 11. The spun thread 21 is formed downstream of the delivery nipping line 20, which thread 21 is fed to a twist device (not shown), for example a ring spindle, in delivery direction B.

In a known way, a top weighting arm 22 forms a component part of the drafting unit 2, which in the present case, apart from the front pressure roller 8 and the other pressure rollers (not shown), also supports the nipping roller 19. Due to the very different weighting pressures of the front pressure roller 8 and the nipping roller 19, the weighting device includes a pressure spring 23 for the front pressure roller 8 and a pressure spring 24 for the nipping roller 19. The force of the pressure spring 23 is many times that of the force of the pressure spring 24. In the drawing, the reaction forces corresponding to the pressure forces are marked as the spring forces $F_1$ and $F_2$ denoted by dot-dash lines.

The nipping roller 19 is applied at a holding device 25, which in the present case, can be swivelled around a swivel axle 26 which is arranged coaxially to the axle of the front pressure roller 8. The swivel axle can alternatively deviate from the axle of the front pressure roller 8. The embodiment with the swivel axle 26 coaxial to the front pressure roller 8 has, however, the advantage that the weighting for the nipping roller 19 is effected solely by the pressure spring 24, so that the weighting forces for the front pressure roller 8 and the nipping roller 19 are in any case independent of one another and can be adjusted as required.

The drive for the nipping roller 19 can be recognized in the drawing by the toothed wheel reference circles denotedy by dot-dash lines, which nipping roller 19 is driven by the front pressure roller 8 via a transfer roller 27, which front pressure roller 8 drives in turn the transport belt 12.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Apparatus of a spinning machine for drafting and subsequent condensing of a fiber strand, comprising:

a drafting unit having a front roller pair, said front rolling pair including a front pressure roller, a condensing zone located downstream of the front roller pair, an air permeable transport belt for transporting the fiber strand through the condensing zone, a suction channel arranged at the condensing zone and having a sliding surface for guiding the transport belt, a suction slit arranged at the sliding surface, a nipping roller, which in use presses the fiber strand and the transport belt to the sliding surface at an end of the condensing zone, a top weighting arm of the drafting unit which supports the nipping roller, and weighting structure for the front pressure roller and the nipping roller including a respective pressure spring for each of the front pressure roller and the nipping roller.

2. Apparatus according to claim 1, wherein the force of the pressure spring for the front pressure roller is many times greater than a force of the pressure spring arranged for the nipping roller.

3. Apparatus according to claim 2, wherein the nipping roller drives the transport belt.

4. Apparatus according to claim 3, wherein the nipping roller is driven by the front roller pair.

5. Apparatus according to claim 4, wherein the nipping roller is arranged on a holding device, which can be swivelled around a swivel axle, disposed coaxially to an axle of the front pressure roller.

6. Apparatus according to claim 3, wherein the nipping roller is arranged on a holding device, which can be swivelled around a swivel axle, disposed coaxially to an axle of the front pressure roller.

7. Apparatus according to claim 2, wherein the nipping roller is arranged on a holding device, which can be swivelled around a swivel axle, disposed coaxially to an axle of the front pressure roller.

8. Apparatus according to claim 1, wherein the nipping roller drives the transport belt.

9. Apparatus according to claim 3, wherein the nipping roller is driven by the front roller pair.

10. Apparatus according to claim 9, where the nipping roller is arranged on a holding device, which can be swivelled around a swivel axle, disposed coaxially to an axle of the front pressure roller.

11. Apparatus according to claim 8, wherein the nipping roller is arranged on a holding device, which can be swivelled around a swivel axle, disposed coaxially to an axle of the front pressure roller.

12. Apparatus according to claim 1, wherein the nipping roller is arranged on a holding device which can be swivelled around a swivel axle disposed coaxially to an axle of the front pressure roller.

13. A weighting assembly for applying loading weight to a drafting unit pressure roller at an exit end of a drafting unit and to a nipping roller disposed at a downstream end of a condensing zone which in use is downstream of the drafting unit and has a fiber strand supporting transport belt traveling over a suctioned member, said nipping roller in use pressing the fiber strand against the transport belt and suctioned member, said weighting assembly including a respective pressure spring for each of the front pressure roller and the nipping roller.

14. A weighting assembly according to claim 13, wherein the force of the pressure spring for the front pressure roller is many times greater than a force of the pressure spring arranged for the nipping roller.

15. A weighting assembly according to claim 14, wherein the nipping roller drives the transport belt.

16. A weighting assembly according to claim 15, wherein the nipping roller is driven by the front roller pair.

* * * * *